US005791094A

United States Patent [19]

Thomson

[11] Patent Number: 5,791,094

[45] Date of Patent: Aug. 11, 1998

[54] MOVABLE WALL FOR BALL COURT

[75] Inventor: Gary G. Thomson, Weeki Wachee, Fla.

[73] Assignee: Diverse Industries, Inc., Spring Hill, Fla.

[21] Appl. No.: 780,272

[22] Filed: Jan. 9, 1997

[51] Int. Cl.[6] ..... E04B 1/396

[52] U.S. Cl. ..... 52/64; 49/130; 472/94

[58] Field of Search ..... 52/64, 109, 1, 52/27, 29; 472/92–94; 160/197, 196.1; 49/130

[56] References Cited

U.S. PATENT DOCUMENTS

| | | | |
|---|---|---|---|
| 4,569,164 | 2/1986 | Dickson | 52/64 |
| 4,716,693 | 1/1988 | Webster | 52/64 |
| 4,829,726 | 5/1989 | DePotter D'Indoye | 52/64 X |
| 4,833,840 | 5/1989 | Kalischewski et al. | 52/64 |
| 4,841,689 | 6/1989 | Schussler | 52/64 |
| 4,844,109 | 7/1989 | Navarro | 52/109 X |
| 5,254,040 | 10/1993 | Eller et al. | 472/94 |
| 5,297,368 | 3/1994 | Okada | 52/64 |
| 5,471,791 | 12/1995 | Keller | 52/64 X |
| 5,577,348 | 11/1996 | Keller | 52/64 X |

*Primary Examiner*—Beth Aubrey
*Attorney, Agent, or Firm*—David Kiewit

[57] ABSTRACT

The size of a walled ball-court's playing area is changed by moving a wall into and out of one side thereof (e.g., the end of an elongate court). The wall moves on wheels rolling in horizontal tracks inset into the floor of the court. The movable wall is mounted on one end of a frame extending outwards from the ball-court, and the weight of the wall is balanced with counterweights so that the wall does not tip when moved. A mechanical drive, which may be manually powered by a single operator, applies horizontal forces to the wall in order to move it back and forth along the tracks. In a preferred embodiment, two sets of wheels, spaced out along the movable wall, are used. In this configuration the spacing between the two sets of wheels is adjustable to allow an installer to select an optimal spacing. Additional safety is provided in a preferred embodiment by providing a safety dog fixedly attached to the frame, extending into the track, and engaging the side of the track whenever the wall tilts forward toward an unstable and unsafe attitude.

9 Claims, 7 Drawing Sheets

MOVABLE WALL FOR BALL COURT

STATEMENT REGARDING FEDERALLY SPONSORED RESEARCH OR DEVELOPMENT

Not Applicable

CROSS REFERENCE TO RELATED APPLICATIONS

Not Applicable

BACKGROUND OF THE INVENTION

1. Field of the Invention

The invention relates to a movable wall usable for changing the size of a ball-court or other room.

2. Description of Prior Art

Racquetball, handball, squash, wallyball and several other games may be played in enclosed ball-courts having walls that a ball in play may be hit against, but that vary in their layout and size. Because of the similarity of the courts, court operators have long desired reconfigurable courts that could be altered to suit the requirements of whatever game was to be played next. Of particular interest to the present invention are two popular games, racquetball and squash, that are played in courts that differ in their length and in the provision of a "tin" section at the base of the front wall of a squash court. Although the "tin" is relatively easy to install or remove, changing the length of the court between the forty foot length mandated for racquetball and the thirty two foot length used for squash has been a serious problem.

The various approaches to making a dual-use court have focused on providing a movable back wall—i.e., the wall opposite to the one against which the ball is served, and have generally used a combination of tempered glass panels and aluminum framing, with the base of the framing mounted on rollers to permit the movable wall to be translated along the length of the court between the two desired limits. In order to provide a flat playing surface, the rollers are generally situated behind the glass panels. Because most of the weight of the movable wall is associated with the glass panels, this arrangement provides an unstable, "frontheavy" structure, weighing approximately half a ton and tending to fall forward onto the court. Although such a wall can be restrained by bolting its frame to the side wall at either playing position, the act of moving such a wall has required the efforts of several people to hold the wall upright and reposition it after other members of the crew have removed the retaining bolts.

Several improvements to the basic movable wall have made the wall repositioning process safer and have reduced the size of the crew needed to move the wall to two people. A movable wall sold by Continental Racquet Sports features a second set of rollers spindled to the wall at its two upper corners and riding in respective tracks recessed into the fixed side walls of the ball court. This wall can be moved by two operators, one walking along each of the fixed side walls, although if the two operators walk at different speeds, the wall can twist about a vertical axis and "rack" or become wedged between the side walls. A movable wall made by A Best Company employs extensible "scissors" gate arrangements on each side of the back surface of the movable wall to prevent both tipping and modifying the playing surfaces by adding tracks in the side walls. Moving this wall also requires two operators walking at the same rate to avoid racking the wall. Two other manufacturers (W&W Glass—Ellis Pearson, Inc.; and Bower Systems, Inc.) have addressed the movable wall problem by providing a dolly for moving the wall. As with the other known moving walls, this arrangement requires two operators moving at the same speed to avoid racking the wall.

SUMMARY OF THE INVENTION

The size of a walled ball-court's playing area is changed by moving a wall into and out of one side thereof (e.g., the end of an elongate court). The wall moves on wheels rolling in horizontal tracks inset into the floor of the court. The movable wall is mounted on one end of a frame extending outwards from the ball-court, and the weight of the wall is balanced with counterweights so that the wall does not tip when moved. A mechanical drive, which may be manually powered by a single operator, applies horizontal forces to the wall in order to move it back and forth along the tracks. In a preferred embodiment, two sets of wheels, spaced out along the movable wall, are used. In this configuration the spacing between the two sets of wheels is adjustable in order to allow an installer to select an optimal spacing for a given installation. Additional safety is provided in a preferred embodiment by providing a safety dog fixedly attached to the frame, extending into the track, and engaging the side of the track whenever the wall tilts forward toward an unstable and unsafe attitude.

It is an object of the invention to provide a movable ball-court wall that can be manually moved into and out of the court by a single operator.

It is a further object of the invention to provide a movable ball-court wall using a combination of safety dogs and counterweights to prevent the wall from tilting away from its normal vertical orientation.

It is yet a further object of the invention to provide a movable ball-court wall mechanically guided so as to not rack between two stationary walls of the ball-court between which the movable wall is traveling.

It is a still further object of the invention to provide a movable wall moving on two or more sets of load bearing wheels that run in tracks set into a floor, where a distance between two adjacent ones of the sets of wheels is adjustable.

DETAILED DESCRIPTION OF THE PREFERRED EMBODIMENT

Figure 1:
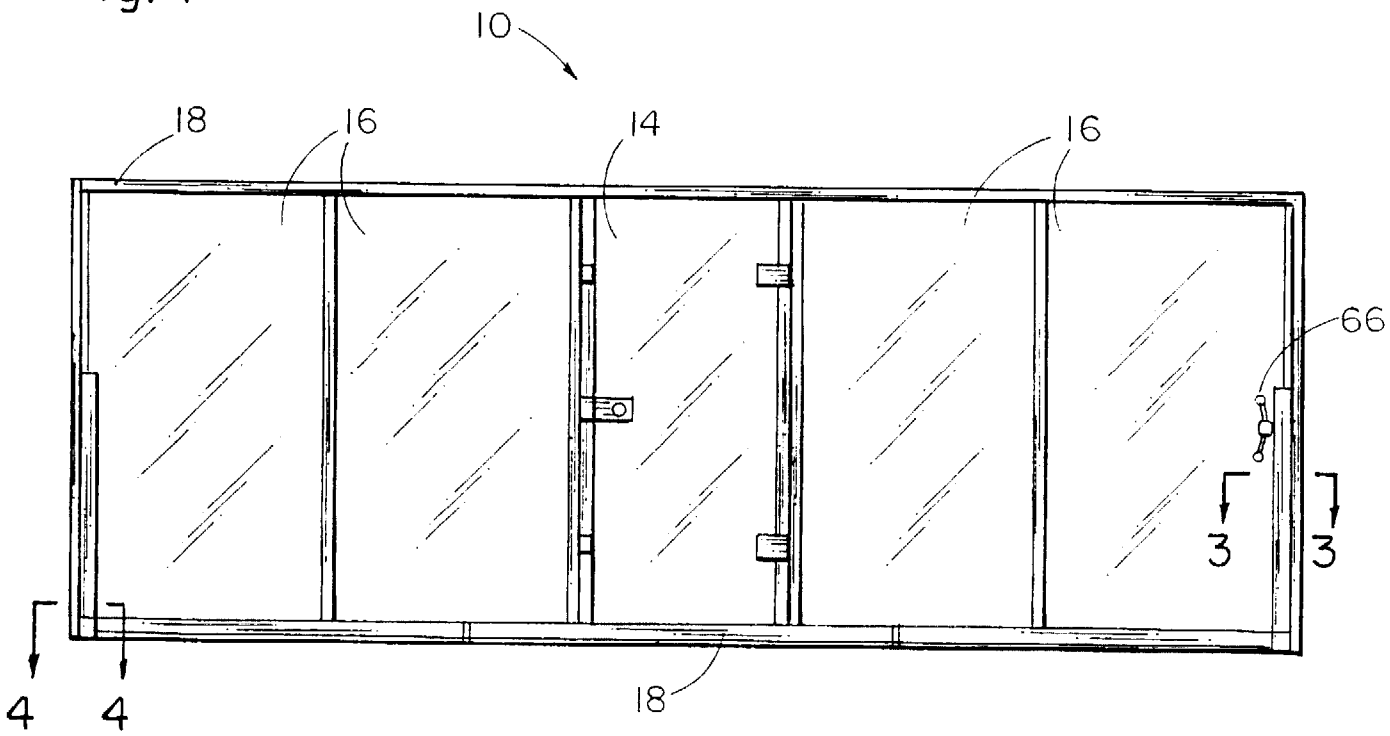
FIG. 1 is a rear elevational view of a movable wall of the invention as viewed from outside a ball-court.
Figure 2:
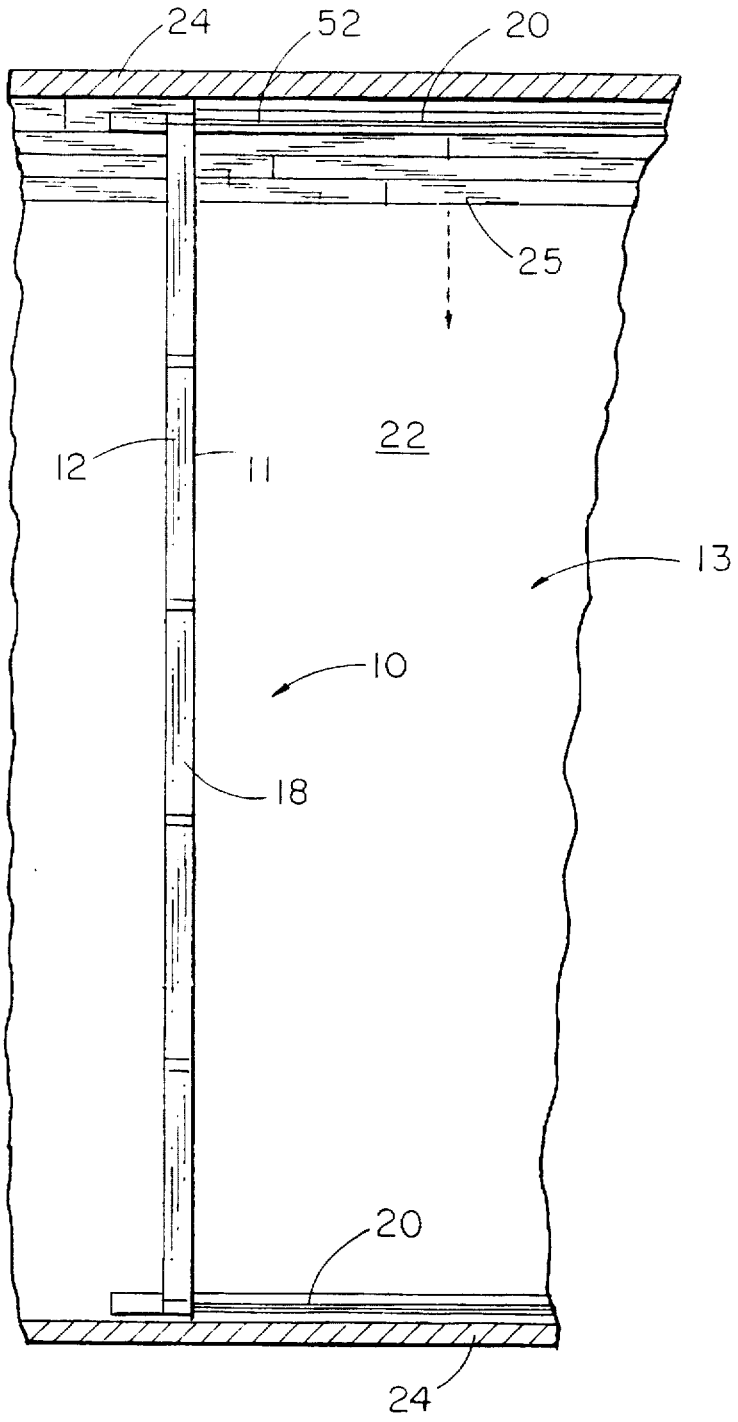
FIG. 2 is an view of a movable wall installed in a ball-court so as to adjust the length of the court.

An upstanding movable wall 10 having a front surface 11 and a rear surface 12 is used as the back wall of a ball-court 13 that is convertible between a racquetball and a squash configuration. The wall 10 is commonly some seven feet high by some twenty feet wide, and incorporates a court entry door 14. The door 14 and the wall panels 16 may be made of tempered glass, of a wood-based composite commonly called "sports panel" or of a number of other materials. The panels 16 are conventionally supported in a frame 18 made of extruded aluminum framing members, although other suitable structural materials, such as steel, may also be used. It may be noted that although it is common to move a seven foot high wall section because seven feet is the maximum playable height of the rear wall in a squash court, other heights up to about twenty feet, which is the maximum playable height for a back, front, or side wall of a racquetball court, may also be considered.

To change the length of a ball-court 13, the preferred movable wall 10 is moved along tracks 20 set into the finished floor 22 of the ball-court 13 so as to be parallel to the side walls 24 thereof. In a preferred embodiment two such tracks 20 are disposed adjacent respective side walls 24, although it will be understood that more tracks 20 and a variety of spacings of the tracks 20 may also be selected. Moreover, it will be understood by those skilled in the art that the tracks 20 should be minimally intrusive. Unobtrusive tracks would fit well enough as to not be noticed underfoot by a player who steps on them in the course of a game, and would not impart an unexpected trajectory, or bad bounce, to any ball that hits them. To accomplish this goal, they should be installed so that their top surfaces are flush with the surface of the floor 22, and should be as narrow as is consonant with their function.

Figure 3:
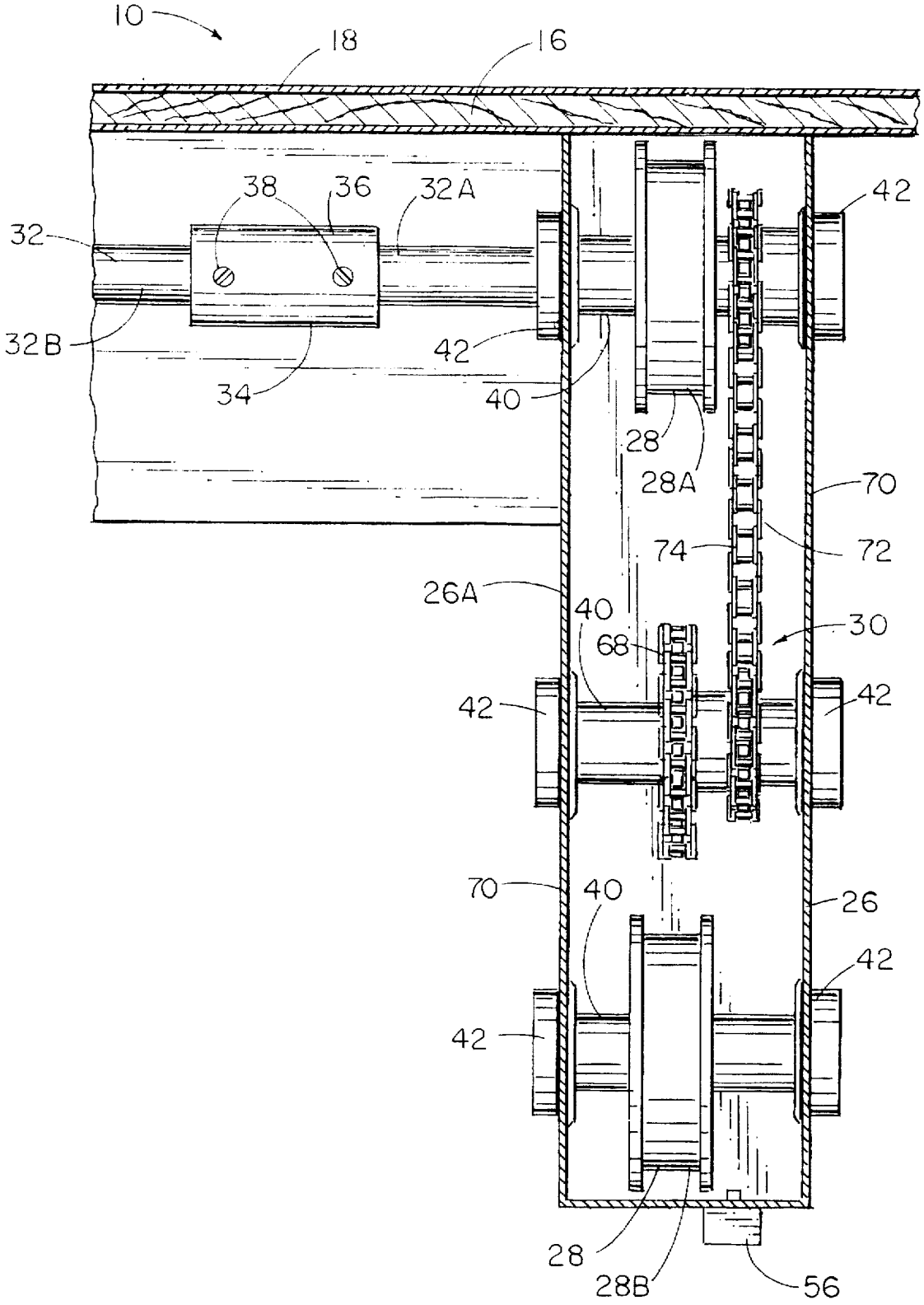
FIG. 3 is a partial plan view, partially in section, of a drive mechanism used to move the wall, the plane of section generally indicated by the double-headed arrows 3—3 in FIG. 1. The floor and the tracks on which the flanged wheels run have been omitted from FIG. 3 in the interest of clarity of presentation.
Figure 4:
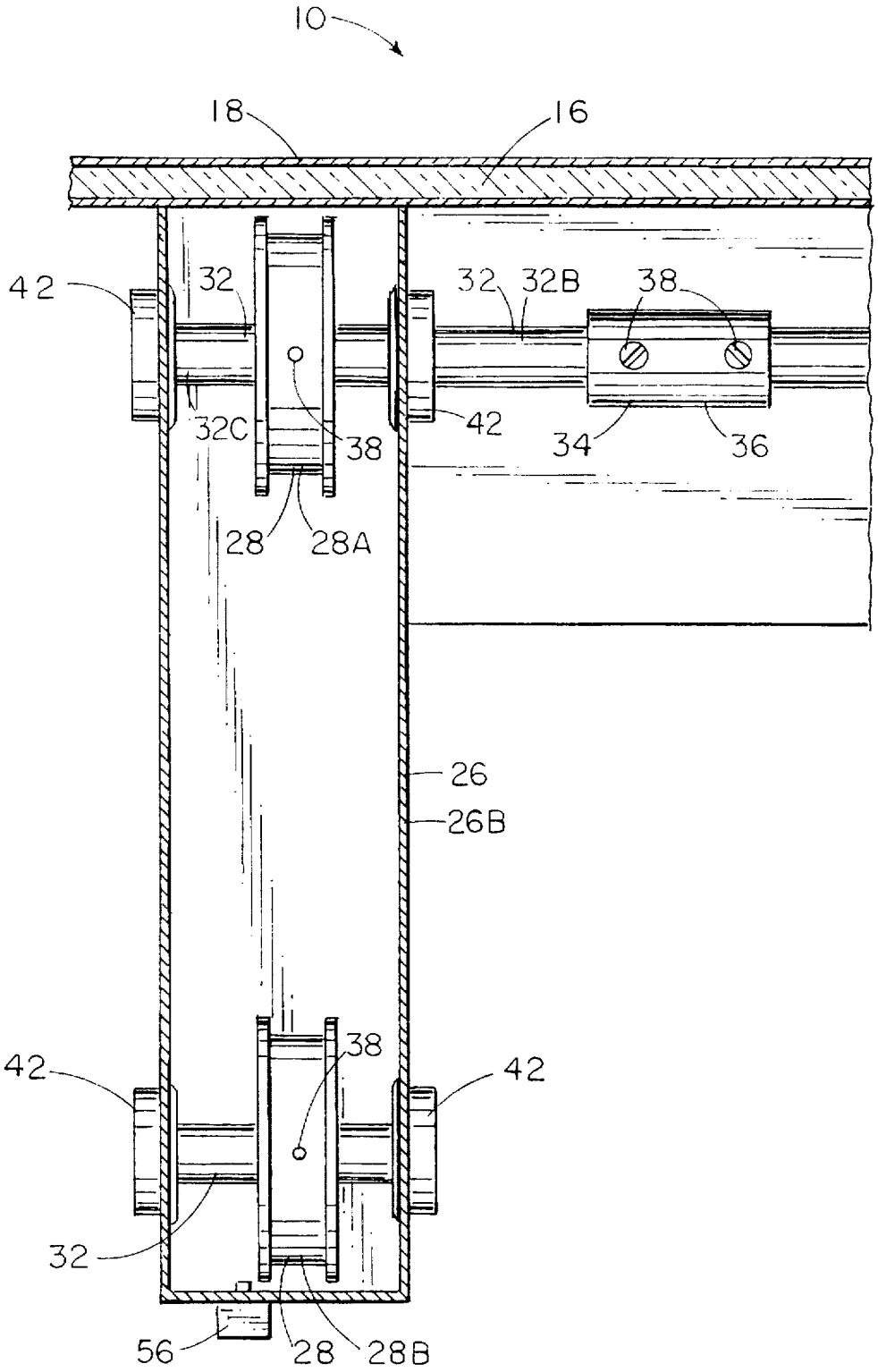
FIG. 4 is a partial plan view, partially in section, of a slave wheel mechanism used to move the wall, the plane of section indicated by the double-headed arrows 4—4 in FIG. 1.

The preferred movable wall 10 comprises two two-wheeled trucks 26 fixedly attached to its frame 18 so that the load of the movable wall is partially borne by four flanged wheels 28 rolling upon rails 48. In this embodiment a drive mechanism 30 is used to turn an axle 32 to which two driven ones 28A of the flanged wheels 28 are fixedly attached so as to rotate with the axle 32. A preferred axle 32 comprises a plurality of coaxial segments 32A, 32B, 32C connected together with in-line couplings 34 permitting axial displacements between adjacent ones of the axle segments so as to provide the desired selectable spacing between the tracks 20 and their respective flanged wheels. The coupling 34, as depicted in FIGS. 3 and 4, may comprise a sleeve tube 36 fitting over a pair of the axle segments 32A, 32B, 32C, which can be shifted to and fro within the sleeve 36 in order to achieve the desired track-to-track spacing before being fixedly attached to the sleeve by means of a set screw 38. As depicted in FIG. 3, appropriately selected spacer sleeves 40 may also be used to select the wheel-to-wheel spacing at the time of installation of the wall. Moreover, as depicted in FIG. 4, the position of a wheel 28 along the axis of its axle 32 may be adjusted by sliding the wheel along the axle and locking it into position with a set screw 38.

In the preferred embodiment both the drive truck 26A and the slave truck 26B have an undriven wheel 28B mounted in a co-linear arrangement with the respective driven wheel 28A so that both of the wheels 28 on one of the trucks 26 ride in the same track. As is depicted in the drawing, the wheels 28 are attached to the respective trucks 26 by a conventional journal bearing 42 arrangement. In a preferred arrangement both the drive truck 26A and the slave truck 26B are adjacent respective ones of the side walls 24, and additional wheels (not shown) are journaled onto the axle 32 for free rotation thereabout at intermediate positions—e.g., at about one third the length of the wall from an end thereof. These additional wheels are not flanged and are preferably of polyurethane or some similar material that is soft enough to allow the additional wheels to ride directly on the finished floor 22 without damaging it.

Figure 6:
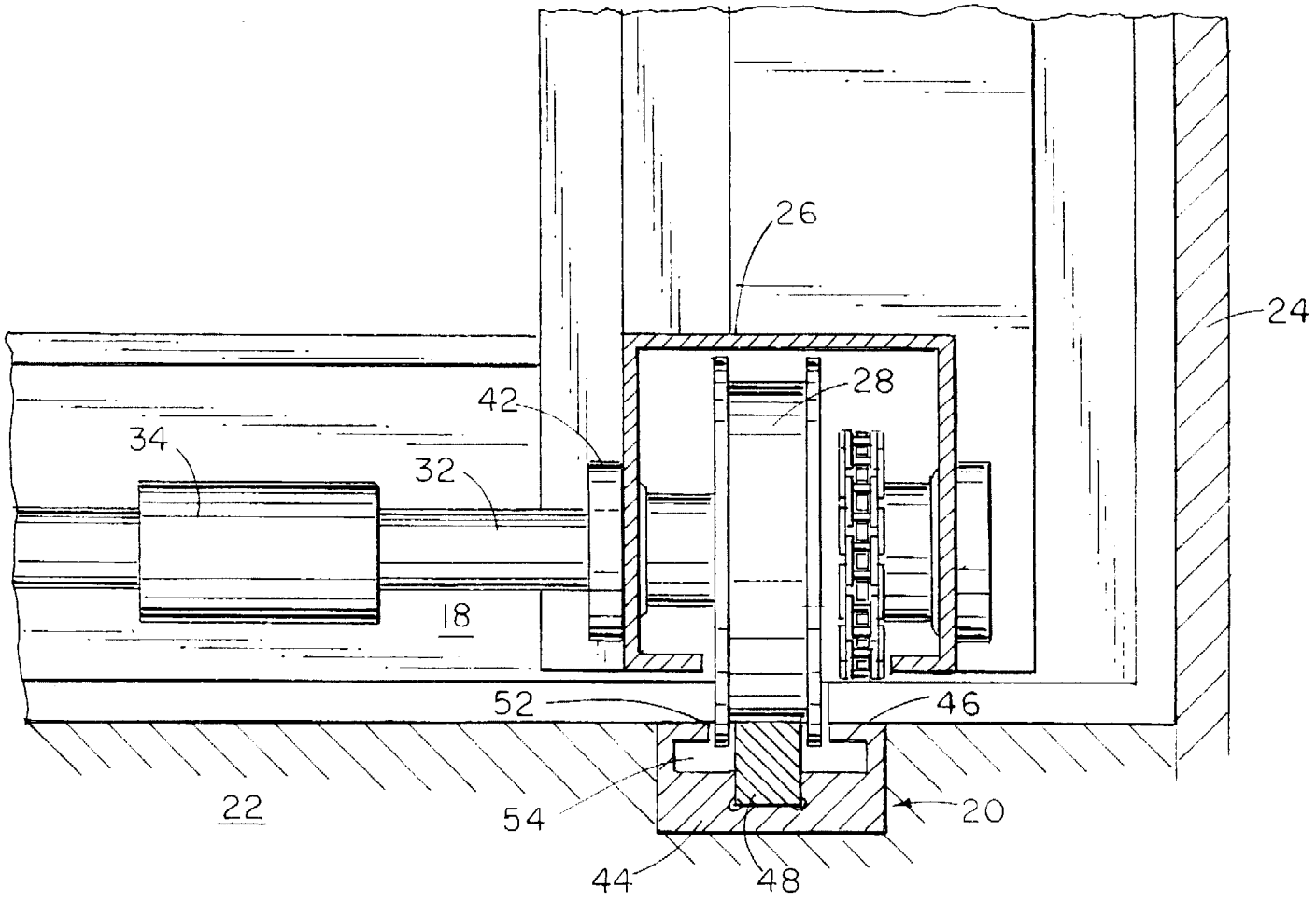
FIG. 6 is a partial cross-sectional view of a preferred arrangement of the load bearing wheels and track, the plane of section indicated by the double-headed arrows 6—6 in FIG. 5.

A preferred track 20, as depicted in FIG. 6, comprises a housing 44 having an upper surface that, at the time of installation, is preferably set even with the top of the finished floor 22. A rail 48 is mounted in the housing 44 and has a width slightly less than the internal flange-to-flange spacing on a wheel 28, so that the wheel 28 can ride upon the rail 48. Selecting the height of the rail 48 so that its top surface 50 is co-planar with the housing's top surface 46 and selecting the width of slot 52 to be only slightly greater that the external flange-to-flange spacing of a wheel 28 provide a minimally intrusive track 20, the advantages of which have been discussed supra.

Figure 7:
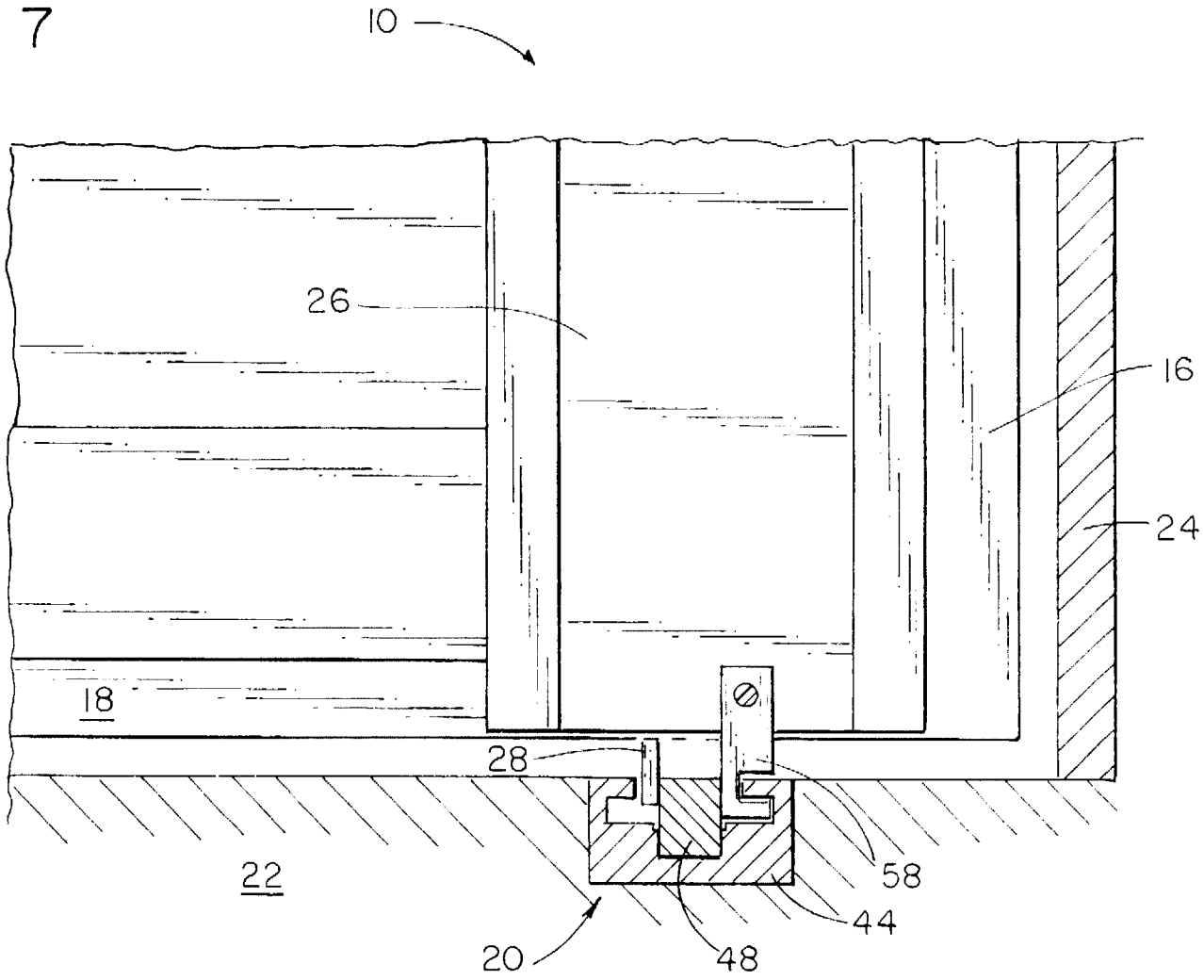
FIG. 7 is a rear elevational view of a wheel truck having a safety dog attached thereto, the view comprising a vertical section through the floor and track.

The preferred housing 44 has an undercut portion 54 extending laterally outwards from the slot 52. As depicted in FIG. 7, a safety dog 56 that is attached to a portion of one of the trucks distal from the panel, and that fits within the undercut portion 54, can be used to prevent the top of the wall 10 from tilting forward into the ball-court 13. It will be clear to those skilled in the art that the rearward extension of the truck 26, which is rigidly attached to the panel 16 (e.g., by being welding to bottom portion of the frame 18 into which the panel members are clamped), serves to prevent the wall 10 from tilting in the opposite direction. The safety dog 56, which is preferably cut from an appropriate metal sheet that is thinner than the lateral flange clearance between the rail 48 and the housing 44, can be conveniently installed after its truck is mounted on the rail by inserting the dog 56 into the flange clearance slot and then turning the dog 56 a quarter turn about a vertical axis and bolting it to the truck in the configuration depicted in FIG. 7.

In a preferred embodiment of the invention, a relatively small range of selection (e.g., about two inches) in the spacing between the tracks 20 is provided so that at the time of installation the tracks can fit into respective spaces created by removing sections of floorboards 25 that are often two and one quarters inches wide, but that may have other widths in approximately the same range. If this small adjustment were not provided, an installer would have to rip-cut or chisel into two floorboards 25 to create a channel in which a track 20 could be mounted. This adjustable spacing feature, of course, requires that one of the two pairs of flanged wheels 28 is attached to the frame 18 by means allowing that pair of wheels to be translated in a direction perpendicular to the tracks so that the spacing between the tracks selected by an installer can be matched with the same spacing between the wheels that ride along those tracks.

Figure 5:
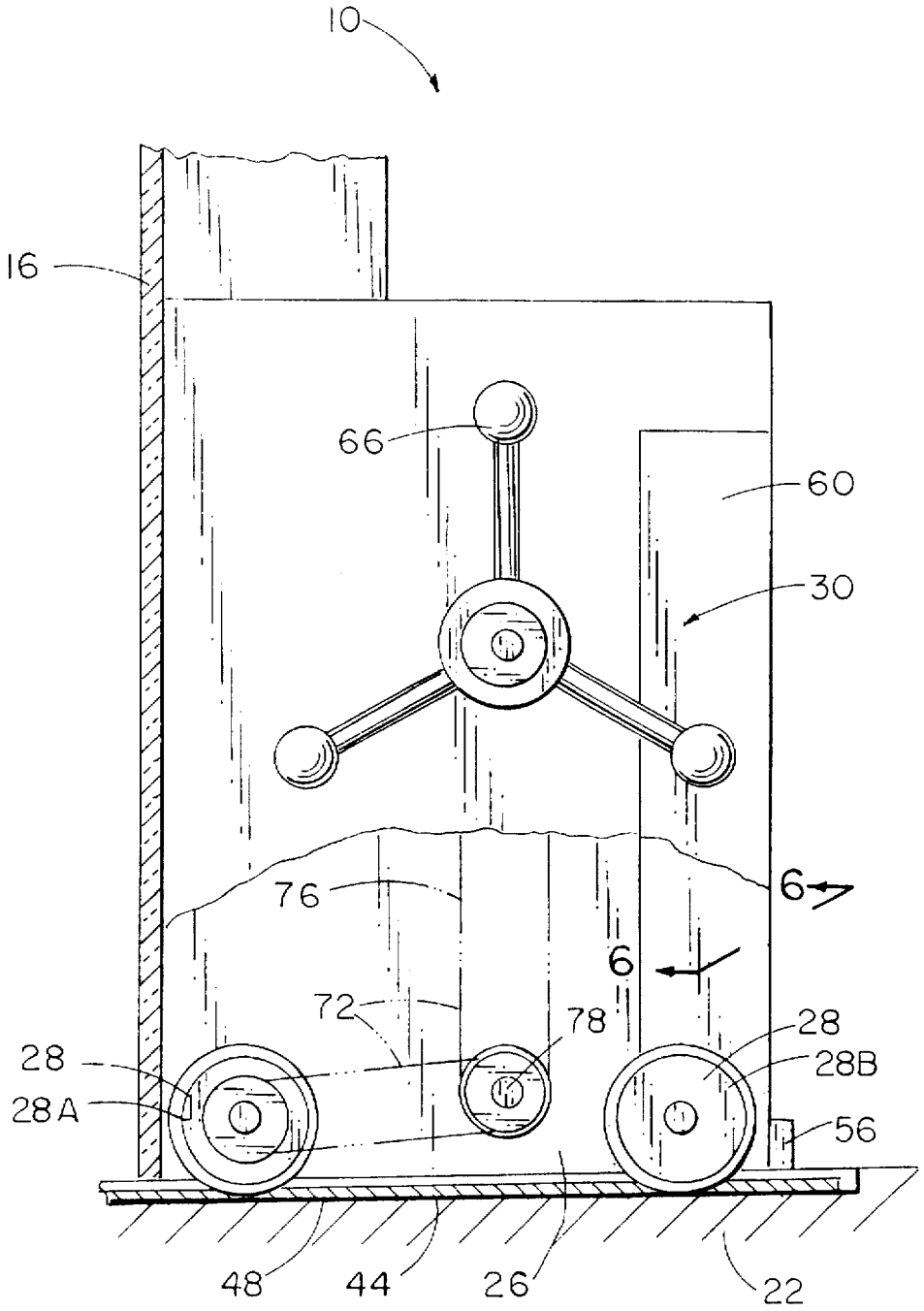
FIG. 5 is a partly cut away side elevational view of the drive mechanism of FIG. 3.

An additional feature of the preferred embodiment is a stabilizing weight or counterweight 60 that is conveniently attached to the rear of each of the trucks 26, as depicted in FIG. 5. The weight of this counterweight 60 can be selected to balance the weight of the wall panels 16 so that each of the two wheels 28A, 28B on a truck 26 carries substantially the same load. It will be recognized that other mounting arrangements for a counterweight (e.g., suspending a weight from an arm extending rearwardly from a portion of the frame adjacent a top of the wall) could also be used, but the preferred configuration places the counterweights near the ends of the wall 10 where people are least likely to bump into them. As is known in the art, dense materials, such as lead, are preferred for the counterweight 60 in order to minimize its size.

Because a movable wall 10 may weigh on the order of one ton, it is desirable to provide a drive mechanism 30 to aid in moving the wall so that the wall can be moved by a single operator. Although one could readily configure a drive mechanism employing an electric motor and appropriate gears, a preferred embodiment employs a manual drive mechanism as depicted in FIGS. 3 and 5. A manually turned crank wheel 66 is used to turn a upper sprocket or pulley 68 affixed to an axle 32 journaled for rotation within bearings 42 mounted on upstanding walls 70 of the drive truck 26A. A first flexible coupling means 72, be which may be a chain 74 or transversely-ribbed belt 76, is employed to turn an intermediate shaft 78 having second and third sprocket or pulley wheels fixedly attached thereto and coupled, by means of as second flexible coupling 72 to a sprocket or pulley wheel attached to the axle segment 32A on which a first of the driven wheels 28A is attached. Gearing arrangements of this sort are well known in the materials handling arts and are used, for example, for moving arrays of closely stacked filing cabinets or warehouse shelves that have weights comparable to that of a movable wall. Thus, it is known that a gearing arrangement such as that depicted in the drawing will allow a single operator to easily move a wheeled wall 10 along a set of tracks 20 by turning a crank wheel 66—e.g., with one hand.

Although the present invention has been described with respect to several preferred embodiments, many modifications and alterations can be made without departing from the invention. For example, one could easily employ the invention to provide a movable side wall or movable front wall for a ball court or could apply equivalent same wall-moving arrangements for moving walls having no relation to a ball court. Accordingly, it is intended that all such modifications and alterations be considered as within the spirit and scope of the invention as defined in the attached claims.

I claim:

1. An apparatus comprising an upstanding movable wall having a front surface and a rear surface, the movable wall supported on a frame extending outward from the rear surface of the movable wall, the moveable wall adapted to be moved across a floor, the apparatus further comprising:

two tracks having respective top surfaces, the tracks adapted to be set into the floor in a parallel spaced-apart relationship so that each top surface is substantially level with the floor, and so that each of the tracks extends perpendicular to the movable wall;

a first pair of load-bearing wheels attached to the frame, each of the first pair of load-bearing wheels rolling along a first of the two tracks, a driven one of the two wheels in the first pair thereof driven by a wheel-driving means controlled by an operator;

a second pair of load-bearing wheels attached to the frame, each of the second pair of load-bearing wheels rolling along the second of the tracks; and a counterweight attached to the frame, the weight of the counterweight selected so that substantially the same load is borne by each of the two wheels in one of the two pairs thereof.

2. The apparatus of claim 1 wherein the driven one of the first pair of wheels and one of the second pair of wheels are fixedly attached to a single drive axle for rotation therewith, the drive axle journaled for rotation within a bearing attached to the frame.

3. The apparatus of claim 1 wherein the wheel driving means comprises a manually turned crank wheel and a flexible coupling operatively connecting the crank wheel to the driven wheel.

4. The apparatus of claim 1 wherein the first and the second pairs of wheels are each disposed within a truck, the apparatus further comprising a safety dog attached to one of the trucks, the safety dog depending from the one of the trucks into an undercut portion of one of the tracks when the pair of wheels disposed within the one of the trucks rolls along the respective one of the tracks.

5. The apparatus of claim 1 wherein the movable wall comprises a portion of a back wall of a ball court.

6. The apparatus of claim 1 wherein one pair of wheels of the first and second pairs of wheels is attached to the frame by means allowing the one pair of wheels to be translated along the moveable wall whereby the spacing between the tracks can be selected by an installer at a time of installation.

7. An apparatus comprising a moveable wall having a base adapted to be moved across a floor in a direction perpendicular to the moveable wall therefore, apparatus further comprising:

a pair of tracks adapted to be set into the floor in a spaced apart relationship along the moveable wall so that an axis of each of the tracks is perpendicular to the moveable wall, each of the tracks comprising a rail and a housing having a slot in an upper surface thereof, a flanged wheel engaging each of the rails, the slot wider than the flanged wheel, the housing further comprising an undercut portion extending laterally outwards from the slot;

a frame attached to the moveable wall adjacent the base thereof, the frame extending outwards from the wall;

extending, each flanged wheel attached about one of a plurality of axles, each of the axles attached to the frame, each flanged wheel adapted to extend through one of the slots and riding upon the respective one of the rails; and a safety dog having two ends, a first end of the dog fixedly attached to the frame, a portion of the safety dog extending downward through one of the slots, whereupon the second end of the safety dog extends laterally into the undercut portion of the respective track housing.

8. The apparatus of claim 7 wherein one of the axles is a drive axle and wherein a first of the flanged wheels rides upon the rail in the first of the tracks and a second of the flanged wheels adapted to ride upon the rail in the second of the tracks, the wheels fixedly attached to the drive axle for rotation therewith, the apparatus further comprising wheel-driving means operatively connected to the drive axle.

9. The apparatus of claim 7 wherein two of the flanged wheels ride upon a first of the two rails, the apparatus further comprising a counterweight having a weight selected so that each of the two wheels carries substantially the same load.

* * * * *

UNITED STATES PATENT AND TRADEMARK OFFICE

CERTIFICATE OF CORRECTION

PATENT NO. : 5,791,094

DATED : August 11,1998

INVENTOR(S) : Thomson

It is certified that error appears in the above-identified patent and that said Letters Patent is hereby corrected as shown below:

Column 6, claim 7:

Line 25, after "moveable wall", replace "therefore," with - - , the - - .

Line 38, delete the first word "extending" and the comma that follows it.

Line 40, replace "adapted to extend" with - - extending - - .

Claim 8:

Line 52, replace "adapted to ride" with - - riding - - .

Signed and Sealed this

First Day of December, 1998

Bruce Lehman

*Attest:*

BRUCE LEHMAN

*Attesting Officer*

*Commissioner of Patents and Trademarks*